US006460706B1

(12) United States Patent
Davis

(10) Patent No.: US 6,460,706 B1
(45) Date of Patent: Oct. 8, 2002

(54) DISC SCREEN APPARATUS WITH AIR MANIFOLD

(75) Inventor: Robert M. Davis, Jamul, CA (US)

(73) Assignee: CP Manufacturing, National City, CA (US)

( * ) Notice: Subject to any disclaimer, the term of this patent is extended or adjusted under 35 U.S.C. 154(b) by 0 days.

(21) Appl. No.: 09/882,667

(22) Filed: Jun. 15, 2001

(51) Int. Cl.[7] ..... B07B 13/14; B07B 13/04; B07B 13/075; B07C 5/06

(52) U.S. Cl. ..... 209/672; 209/671; 198/836.2

(58) Field of Search ..... 198/836.1, 836.2, 198/493; 209/672, 673, 671

(56) References Cited

U.S. PATENT DOCUMENTS

| | | | | | |
|---|---|---|---|---|---|
| 871,743 | A | * | 11/1907 | Tice | 209/279 |
| 1,012,046 | A | * | 12/1911 | Anderson | 209/279 |
| 2,055,630 | A | * | 9/1936 | McLean | 209/279 |
| 2,477,006 | A | * | 7/1949 | Pierson | 209/243 |
| 3,861,516 | A | * | 1/1975 | Inose et al. | 198/35 |
| 4,377,474 | A | * | 3/1983 | Lindberg | 209/279 |
| 4,658,965 | A | * | 4/1987 | Smith | 209/672 |
| 4,755,286 | A | * | 7/1988 | Bielagus | 209/243 |
| 4,781,205 | A | * | 11/1988 | Shakley | 134/131 |
| 4,903,845 | A | * | 2/1990 | Artiano | 209/671 |
| 5,032,255 | A | * | 7/1991 | Jauncey | 209/38 |
| 5,116,486 | A | | 5/1992 | Pederson | 209/12 |
| 5,202,133 | A | * | 4/1993 | Pesch et al. | 425/83.1 |
| 5,234,109 | A | | 8/1993 | Pederson | 209/12 |
| 5,480,034 | A | | 1/1996 | Kobayashi | 209/667 |
| 5,836,527 | A | | 11/1998 | Irwin et al. | 241/49 |
| 6,318,560 | B2 | * | 11/2001 | Davis | 209/672 |
| 6,374,998 | B1 | * | 4/2002 | Grubbs et al. | 198/836.2 |

FOREIGN PATENT DOCUMENTS

| | | | | |
|---|---|---|---|---|
| CA | 2054615 A | | 5/1992 | B07B/1/00 |
| DE | 439002 | * | 1/1927 | 209/672 |
| SU | 1270195 | * | 11/1986 | 209/672 |

* cited by examiner

*Primary Examiner*—Donald P. Walsh
*Assistant Examiner*—Daniel K Schlak
(74) *Attorney, Agent, or Firm*—Michael H. Jester

(57) ABSTRACT

Air is directed downwardly from at least one laterally extending air manifold to push newspaper in a stream of mixed recyclable materials against the discs of an inclined disc screen to ensure that the newspaper is conveyed upwardly over an output end of the screen while containers and bottles in the stream tumble downwardly off a lower input end of the screen. In an alternate embodiment, the disc screen has a V-shaped configuration with a lowermost region that provides a laterally inclined trough that received the mixed recyclable materials.

21 Claims, 4 Drawing Sheets

DISC SCREEN APPARATUS WITH AIR MANIFOLD

FIELD OF THE INVENTION

The present invention relates to machines for processing mixed recyclable materials, and more particularly, to disc screen apparatus suited for separating newspaper from a stream of mixed recyclable materials.

BACKGROUND OF THE INVENTION

Material recycling has become an important industry in recent years due to decreasing landfill capacity, environmental concerns and dwindling natural resources. Many industries and communities have adopted voluntary and mandatory recycling programs for reusable materials. Solid waste and trash that is collected from homes, apartments or companies often combine several recyclable materials into one container. When brought to a processing center, the recyclable materials are frequently mixed together in a heterogenous mass of material. Mixed recyclable materials include newspaper, magazines, aluminum cans, plastic bottles, glass bottles and other materials that may be recycled.

Disc apparatus or "disc screens" are increasingly used to separate streams of mixed recyclable materials into respective streams or collections of similar materials. This process is referred to as "classifying", and the results are called "classification". A disc screen typically includes a frame in which a plurality of rotatable shafts are mounted in parallel relationship. A plurality of discs are mounted on each shaft and a chain drive commonly rotates the shafts in the same direction. The discs on one shaft interleave with the discs on each adjacent shaft to form screen openings between the peripheral edges of the discs. The size of the openings determines the dimension (and thus the type) of material that will fall through the screen. Rotation of the discs, which have an irregular outer contour, agitates the mixed recyclable materials to enhance classification. The rotating discs propel the larger articles which are too big to fall between the discs across the screen. The general flow direction extends from an input area where the stream of material pours onto the disc screen to an output where the larger articles pour off of the disc screen. The smaller articles fall between the discs onto another disc screen or a conveyor, or into a collection bin.

There is a substantial market for recycled newspaper. Therefore, it is important that any disc screen which is designed to classify mixed recyclable materials be capable of thoroughly separating newspaper from the heterogenous mass of material. Prior disc screen apparatus designed to handle a stream of mixed recyclable materials have included multiple overlapping disc screens with different angles of inclination and different sizes of openings between the discs. They are capable of separating broken glass from containers. They are also capable of separating mixed paper and newspaper from the stream of mixed recyclable materials. These apparatus can be tilted at various angles to improve the efficiency of separation. However, a consistent problem that has been encountered with disc screen apparatus that is used to classify mixed recyclable materials is the fact that newspaper sometimes rolls into a clump or mass midway up the final disc screen and will not be ejected off of the upper terminal end thereof If the angle of inclination of the final disc screen is reduced, then containers and bottles will be undesirably conveyed up the final disc screen and off of its discharge end. This problem is exacerbated where the newspaper is wet or damp.

SUMMARY OF THE INVENTION

In accordance with the present invention air is directed downwardly from at least one laterally extending air manifold to push newspaper in a stream of mixed recyclable materials against the discs of an inclined disc screen to ensure that the newspaper is conveyed upwardly over an output end of the screen while containers and bottles in the stream tumble downwardly off a lower input end of the screen. In an alternate embodiment, the disc screen has a V-shaped configuration with a lowermost region that provides a laterally inclined trough that receives the mixed recyclable materials.

DESCRIPTION OF THE PREFERRED EMBODIMENTS

Figure 1:
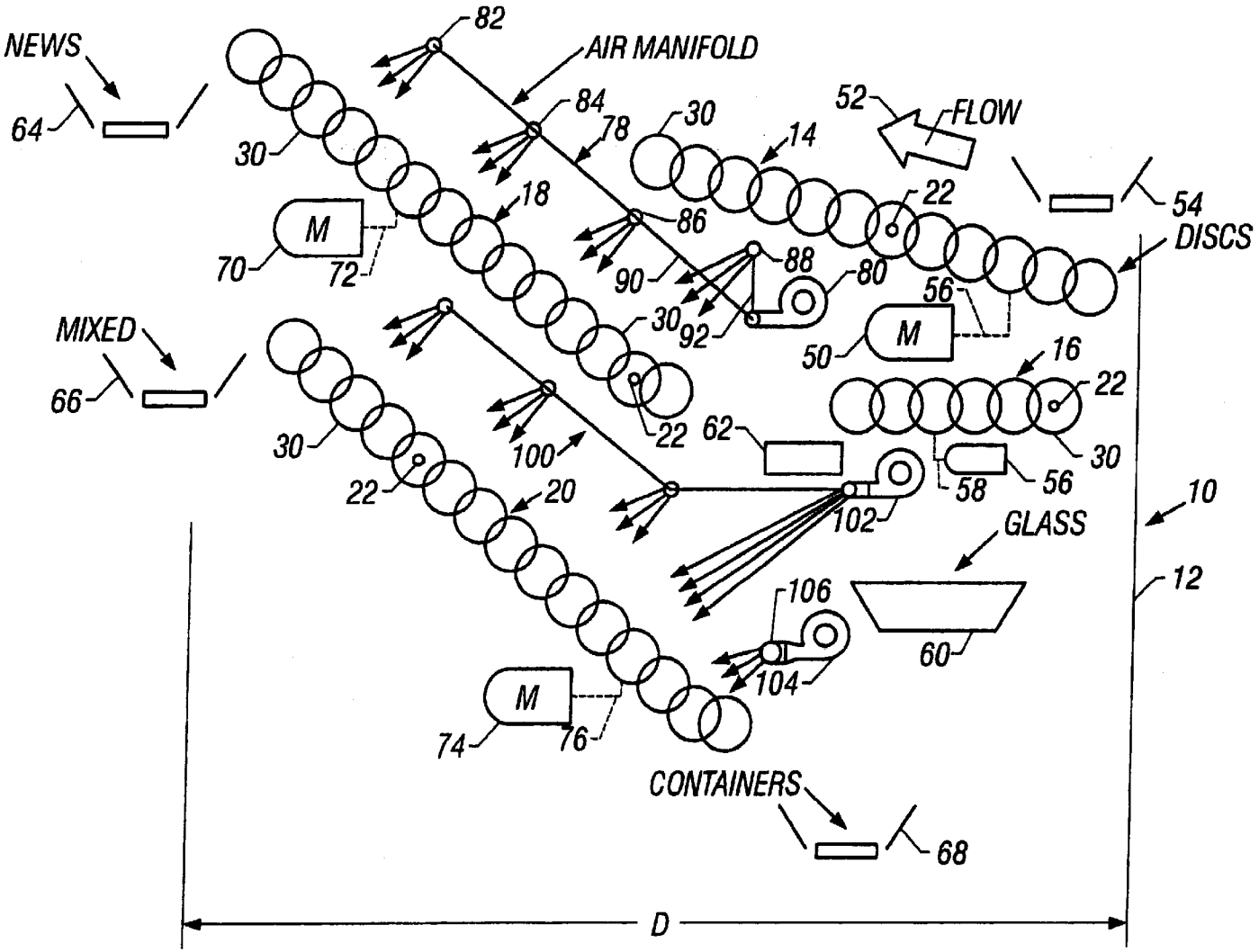
FIG. 1 is a diagrammatic side elevation view of a recycling apparatus in accordance with a first embodiment of the invention.

Referring to FIG. 1, a first embodiment of the present invention comprises a recycling apparatus 10 that separates and classifies a stream of mixed recyclable materials of various sizes and shapes, including newspaper, magazines, plastic bottles, glass bottles and jars, cans, and the like. The apparatus includes a frame 12 that supports a first disc screen 14, a second disc screen 16, a third disc screen 18 and a fourth disc screen 20. Each disc screen, such as 18 (FIG. 2A), is comprised of a plurality of shafts such as 22 (FIG. 3A) whose axes, such as 24, 26 and 28 (FIG. 2A) are spaced apart and parallel, and extend laterally between opposite sides 12*a* and 12*b* of the frame 12. The shafts 22 are located at progressively greater heights spaced along the longitudinal direction (from right to left in FIG. 1).

The frame 12 (FIG. 1) is typically an enclosure formed of welded and/or bolted together steel plates. The frame 12 has solid walls for safety reasons, although it may comprise an open framework. By way of example, the length D of the recycling apparatus 10 may be approximately twenty-six feet. Each shaft 22 (FIG. 3A), preferably has a square cross section and its opposite ends are journaled in bearings (not illustrated) supported by respective sides 12*a* and 12*b* (FIG. 2A) of the frame 12.

Figure 2A:
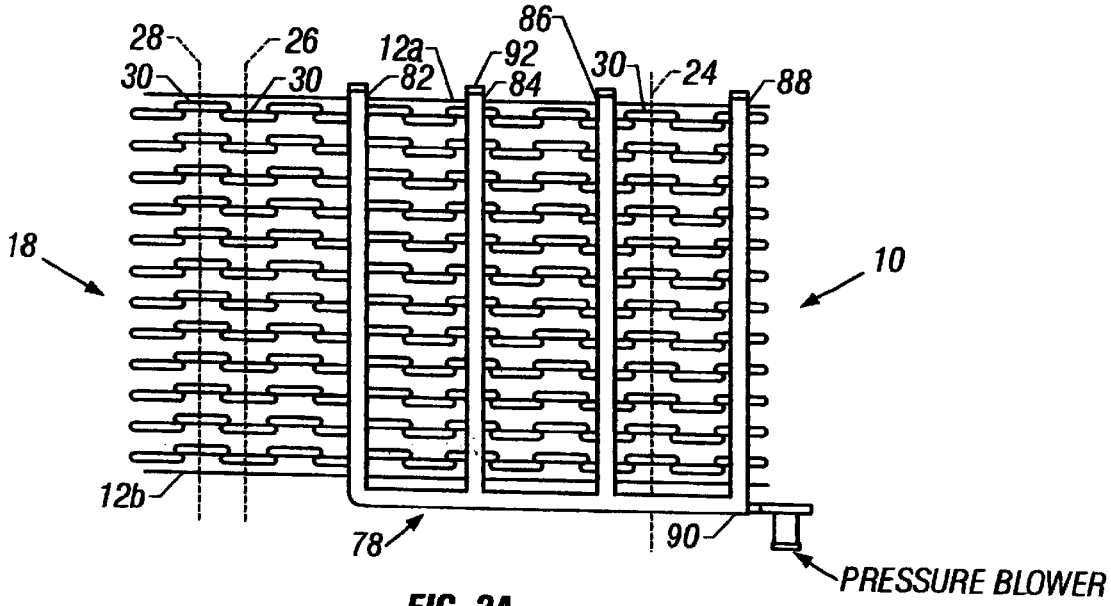
FIG. 2A is a top plan diagrammatic view of the third disc screen of the apparatus of FIG. 1.
Figure 3C:
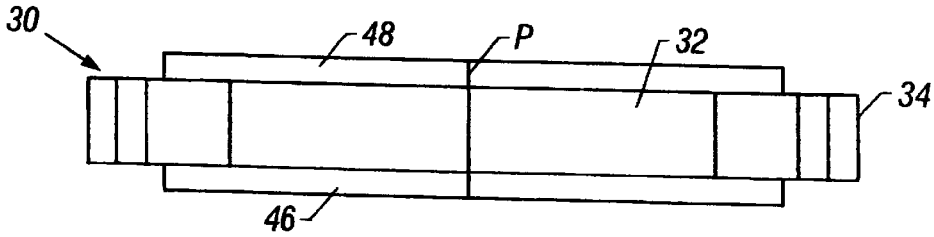
FIG. 3C is an end elevation view of the disc taken from the bottom of FIG. 3A.
Figure 3B:
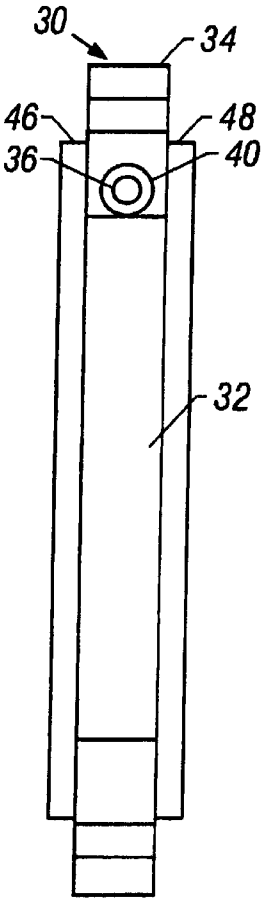
FIG. 3B is an end elevation view of the disc taken from the left side of FIG. 3A.
Figure 3A:
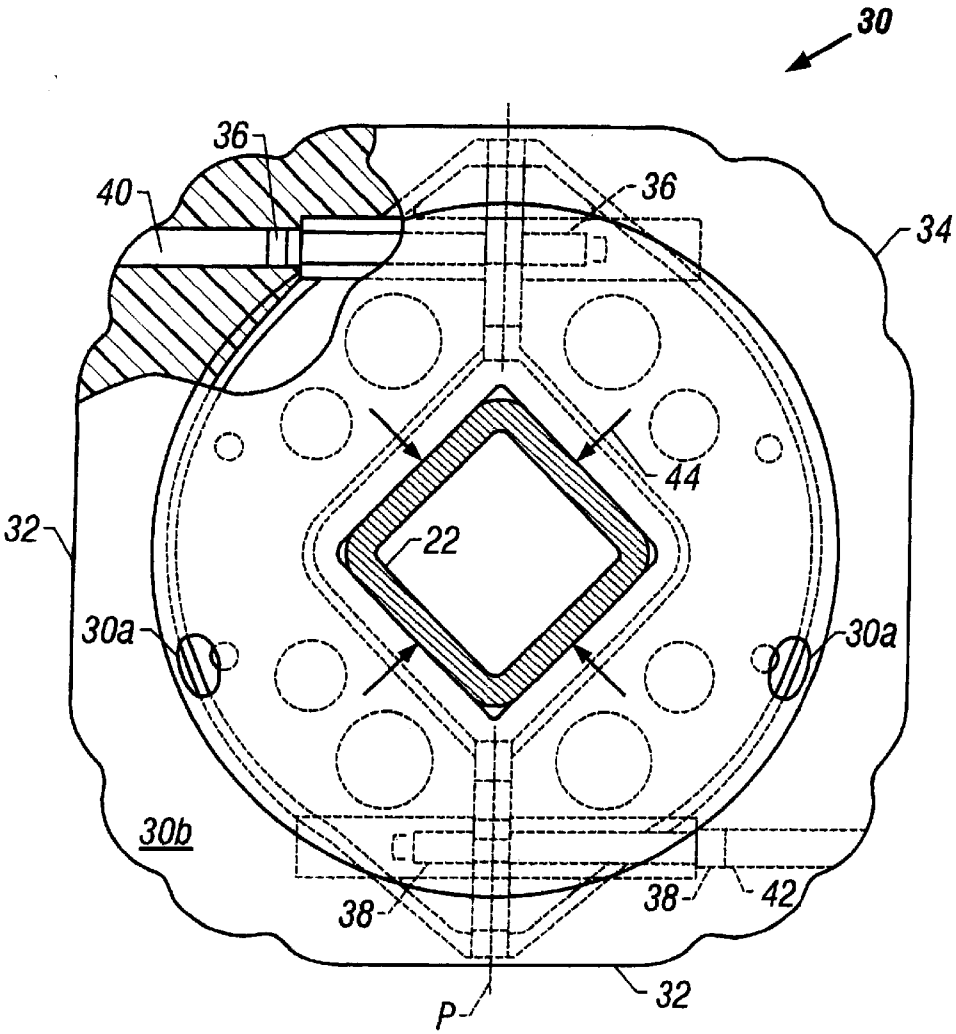
FIG. 3A is a greatly enlarged, fragmentary side elevation view of one of the discs of the first embodiment with hidden portions shown in phantom lines.

Each of the screens, such as 18 (FIG. 2A), further includes a plurality of discs 30 (FIG. 3A). The discs 30 on each shaft 22, such as the shaft that rotates around the axis 26 (FIG. 2A), are mounted along the shaft at equal laterally spaced intervals. The discs 30 on the shaft that rotates around the axis 26 are interleaved with, and overlapped in the longitudinal direction (left to right in FIG. 2A) with the discs 30 on the adjacent shafts, such as the shaft that rotates around the axis 28.

While the discs 30 are referred to "discs" they preferably have an irregular outer contour or shape so that when all of the shafts 22 of a screen, such as 18, are rotated in the same direction, mixed recyclable materials deposited thereon will be agitated and moved along in a conveying direction. In accordance with well know techniques, the spacing of the discs 30 and the resulting dimensions of the openings therebetween determines the size of the materials that will fall downwardly between the discs 30.

As illustrated in FIG. 3A, each disc 30 has a generally square or rectangular outer contour that includes four flat segments 32 and four scalloped comer segments 34. The disc 30 includes an inner rigid steel or aluminum frame 30*a* and an elastomeric outer covering 30*b*. The disc 30 is formed in two half sections which separate along a parting line P and which are clamped along the corresponding shaft 22 by a pair of bolt assemblies 36 and 38. These bolt assemblies extend through corresponding bores 40 and 42 in the half-sections of the covering 30*b* and through the half-sections of the rigid inner frame 30*a*. The bolt assemblies 36 and 38 apply a clamping force around the corresponding shaft 22 as indicated by the solid arrows 34.

As best seen in FIGS. 3B and 3C, each disc 30 is formed with laterally extending, shoulder portions 46 and 48. Shoulder portions 46 and 48 have a round outer contour and are recessed in a radial direction compared to the outer contour of the disc 30 formed by its flat and scalloped segments 32 and 34. The discs 30 on adjacent shafts in a given screen such as 18 can be positioned so that the shoulder portion of one disc will be directly opposed to the shoulder portion of a disc on the adjacent shaft. The lateral spacing of the discs 30 on a given shaft 22 can be continuously adjustable. Alternatively, the lateral position of each disc 30 on a given shaft 22 may be fixed by means of a pin, bolt or other protrusion which extends radially inwardly from the inner rigid frame 30*a* and registers with a hole (not illustrated) formed in the shaft 22.

The outer covering 30*b* of the disc 30 is preferably made of a material that will provide a high abrasion resistance relative to the materials which impact it, while at the same time provide a high coefficient of friction for conveying the materials along the conveying direction of the screen. The covering 30*b* may be made of synthetic rubber which is molded around the inner frame 30*a*. It is important to utilize an elastomeric material to provide cushioning to the materials as they fall onto the screen to absorb the impact forces.

Referring again to FIG. 1, the first screen 14 has a generally planar configuration, i.e., the axes of its shafts 22 generally extend in a common plane. The disc screen 14 is slightly inclined from an input end on the right side thereof to an output end on the left side thereof. A motor 50 rotates the discs 30 of first screen 14 in a common counter-clockwise direction in FIG. 1 for moving the mixed recyclable materials along an inclined conveying direction represented by the arrow 52. Mixed recyclable materials are deposited onto the lower input end of the first screen 14 by a conveyor 54. The motor 50 rotates the discs 30 of first disc screen 14 via a drive linkage shown diagrammatically as a dashed line 56. The drive linkage 56 may include gears, belts, other suitable drive means well known in the art. Typically the shafts 22 of the disc screen 14 are driven by a chain and sprocket drive (not illustrated).

Initially the stream of mixed recyclable materials from the conveyor 54 pours onto the lower input end of the first disc screen 14. The discs 30 of the first several shafts 22 of the disc screen 14 are closely spaced so that fine material, such as broken glass, falls through the first disc screen 14 onto the second disc screen 16. The second disc screen 16 extends horizontally. The discs 30 of the second disc screen 16 are driven by another motor 56 through a drive linkage 58, and are configured and spaced to further divide the material that has fallen onto the second disc screen 16 into a finer portion collected in bin 60 and a coarser portion that is conveyed to the left off of the second disc screen 16 into another bin 62.

The remainder of the mixed recyclable materials is conveyed upwardly to the left along the first disc screen 14 where it tumbles off of the upper output end thereof onto the lower input end of the third disc screen 18. The third disc screen 18 also has a generally planar configuration and is inclined at an angle that is steeper that the first disc screen 14. The spacing of the discs 30 of the third disc screen 18 and the angle of inclination of the disc screen 18 are carefully selected so that newspaper will be conveyed off of an upper output end of the third disc screen 18 onto a conveyor an 64. As the discs 30 of the third disc screen 18 rotate, they agitate the mixed recyclable materials which have been deposited onto the third disc screen 18. Cans, mixed paper and other smaller remaining articles fall through the discs 30 of the third disc screen 18 onto the fourth disc screen 20. Larger articles such as plastic milk bottles and large soda pop bottles roll backward and fall off the lower end of the third disc screen 18 onto the lower end of the fourth disc screen 20.

The fourth disc screen 20 also has a generally planar configuration and has an angle of inclination roughly comparable to the angle of inclination of the third disc screen 18. Mixed materials which have fallen through the discs 30 of the third disc screen 18 are conveyed upwardly and spill over the output end of the fourth disc screen 20 onto a conveyor 66. Large articles such as milk bottles and soda pop containers roll off of the fourth disc screen 20 onto a conveyor 68. The discs 30 of the third conveyor 18 are rotated in a common direction by a motor 70 which is coupled thereto through drive linkage 72. The discs 30 of the fourth disc screen 20 are rotated in a common direction by another motor 74 which is coupled thereto through another drive linkage 76.

The recycling apparatus 10 is provided with pneumatic means for enhancing the classification of the stream of mixed recyclable materials. More particularly, a first air manifold 78 (FIG. 1) is positioned above the third disc screen 18 and is coupled to a first blower 80. Referring to FIG. 2A, the first air manifold 78 includes four laterally extending branch conduits 82, 84, 86 and 88 that extend laterally across substantially the entire width of the third disc screen 18. One set of ends of the conduits 82, 84 and 86 are coupled to a common header 90 that is coupled to the blower 80. One end of the conduit 88 is connected to another conduit 92 (FIG. 1) that is also coupled to the blower 80. The other ends of the conduits 82, 84, 86 and 88 are sealed with caps 92 (FIG. 3A). Each of the conduits 82, 84, 86 and 88 blows a plurality of streams of air downwardly against the recyclable materials on the discs 30 of the third disc screen 18. This is illustrated diagrammatically by the fanned arrows in FIG. 1. This helps pin the newspaper against the discs 30 to enable the discs 30 to convey the newspaper off of the upper output end of the third disc screen 18 onto the conveyor 64. The use of the first air manifold 78 with the third disc screen 18 allows the angle of inclination of the third disc screen 18 to be increased and thereby ensure that only paper will be conveyed off of the output end of the third disc screen 18 onto the conveyor 64. Mixed materials will fall between the discs 30 of the third disc screen 18 onto the fourth disc screen 20. Large articles such as milk bottles and soda pop containers will tumble rearwardly and downwardly off of the lower end of the third disc screen 18 onto the lower end of the fourth disc screen 20.

Figure 2B:
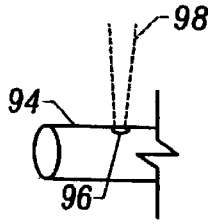
FIG. 2B is a fragmentary illustration of one of the air manifold conduits of the first embodiment.

The first air manifold 78 may be made of interconnected plastic pipe, such as ABS pipe commonly used for plumbing applications. This pipe can be cut and connected with conventional elbows, T-connectors and the like to provide the desired configuration. FIG. 2B illustrates a section 94 of plastic pipe with a hole 96 drilled therein to form a nozzle which ejects a stream 98 of air based on the pressure generated by the blower 80. The spacing and size of the holes 96 can be selected to achieve the optimum results, along with the number, quantity and spacing of the conduits 82, 84, 86 and 88 etc. For example, the pipe 94 may be made of four inch diameter PVC plastic with holes 96, spaced approximately two feet a part. The holes 96 may have a diameter of, for example, ¼" to approximately ⅜". The conduits 82, 84, 86 and 88 are preferably spaced close enough to the third disc screen 18 so that large articles such as milk bottles and soda pop containers can bounce over the conduits as they are agitated by the irregular shaped rotating discs 30. Preferably, the air streams, such as 98, which are generated by the first air manifold 78 are angled slightly forwardly, i.e., between about five and fifteen degrees forward of a line drawn perpendicular to the plane of the third disc screen 18. This has the effect of not only pushing the newspaper down against the discs 30 of the disc screen 18, but also helps convey the newsprint upwardly (to the left in FIG. 1). The conduits 82, 84, 86 and 88 are preferably rotatable to adjust the angle of the air streams 98.

The recycling apparatus 10 further includes a second air manifold 100 (FIG. 1) connected to a second blower 102 which may have a construction and configuration similar to the first air manifold 78. The second air manifold 100 is positioned above the fourth disc screen 20 and facilitates the movement of mixed recyclable materials upwardly along the conveying direction of the fourth disc screen 20 over the output end of the fourth disc screen 20 onto the convey 66. Larger articles, such as milk bottles and soda pop containers, tumble downwardly and rearwardly off of the lower end of the fourth disc screen 20 onto the conveyor 68. The second air manifold 100 permits the angle of inclination of the fourth disc screen 20 to be higher than would be otherwise possible since it helps the discs 30 of the fourth disc screen 20 engage and drive upwardly the mixed recyclable materials.

Persons skilled in the art of designing apparatus for classifying a stream of mixed recyclable materials will appreciate that the disc spacings, angles of inclination, and rotational speeds of the recycling apparatus 10 are selected to ensure that the four disc screens, 14, 16, 18 and 20, will optimally classify and sort the input stream of mixed recyclable materials into its various portions or components to achieve the highest percentage or degree of homogeneity of the portions. By way of example, the rotational speed of the shafts 22 of the first disc screen 14 may be around sixty to one hundred revolutions per minute and the rotational speed of the shafts 22 of the third disc screen 18 may be between approximately two hundred and three hundred revolutions per minute.

Referring again to FIG. 1, a third blower 104 is connected to another laterally extending conduit 106 which blows a plurality of streams of air downwardly and at an angle between the first and second shafts 22 of the fourth disc screen 20. These streams of air ensure that any mixed recyclable materials that have fallen onto the lower portion of the fourth disc screen 20 will not move off of the lower end of the fourth disc screen 20.

Figure 4:
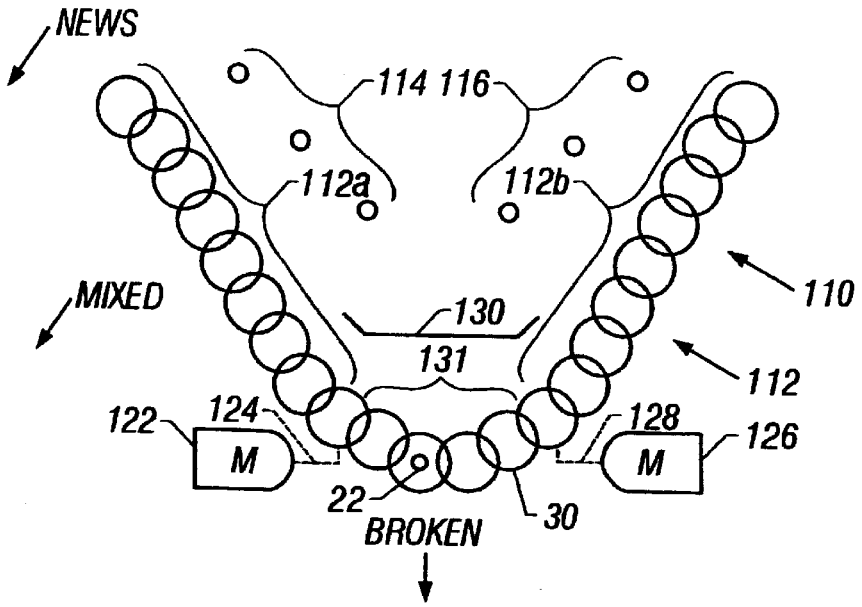
FIG. 4 is a diagrammatic side elevation view of a second embodiment of the present invention.
Figure 5:
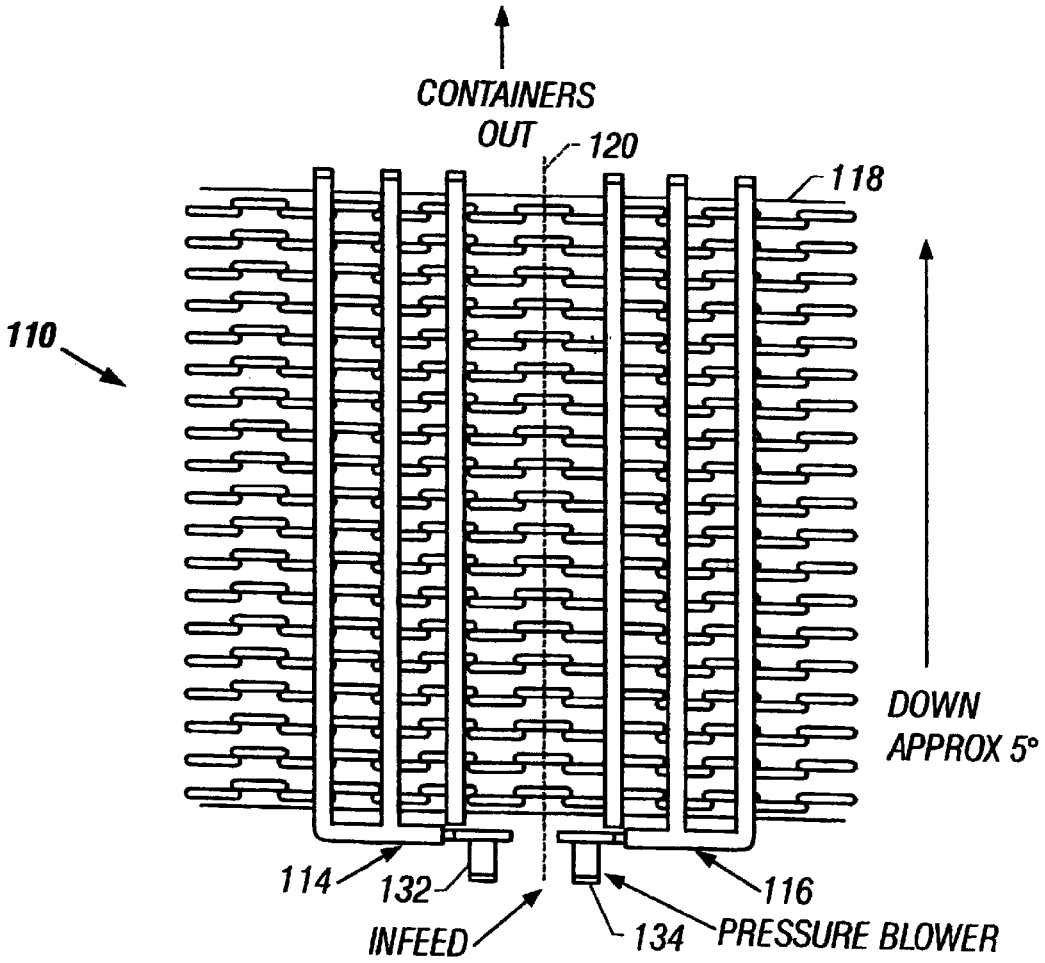
FIG. 5 is a fragmentary top plan elevation view of the second embodiment.

Referring to FIG. 4, a second embodiment of the present invention comprises a recycling apparatus 110 in the form of a trough-shaped disc screen 112 equipped with a pair of separate air manifolds 114 and 116. Referring to FIG. 5, the recycling apparatus 110 includes a frame 118 that rotates a plurality of laterally extending shafts 22 that rotate about laterally extending axes such as 120. The shafts 22 of the trough-shaped disc screen 112 are longitudinally spaced and are located at progressive heights to provide a generally V-shaped configuration as best seen in FIG. 4. The shaft that rotates about the axis 120 (FIG. 5) and the additional shafts to the left of axis 120 are rotated by a motor 122 through a drive linkage 124 in a counter-clockwise direction in FIG. 4. The shafts to the right of the axis 120 (FIG. 5) are rotated by another motor 126 (FIG. 4) via a drive linkage 128 to rotate the discs 30 on these shafts in a clockwise direction in FIG. 4.

A stream of mixed recyclable materials is carried by a conveyor 130 (FIG. 4) and deposited onto a lowermost region 131 of the trough-shaped disc screen 112. The shafts of the disc screen 112 are preferably slightly downwardly angled from the horizontal, at an angle, for example, of about five degrees. The spacing of the discs 30 along the various shafts of the trough-shaped disc screen 112 and the angle of inclination of the two vertically inclined regions 112*a* and 112*b* of the disc screen 112, along with the rotational speed of these discs, is selected to optimumly classify the stream of mixed recyclable materials with the conveyor 130. This optimum classification is enhanced by the air manifolds 114 and 116 which are connected to blowers 132 and 134 (FIG. 5). The manifolds 114 and 116 are generally similar in construction, configuration and positioning to the first and second air manifolds 78 and 100 of the recycling apparatus 10. Broken glass falls downwardly between the discs 30 of the lowermost region 131 of the trough-shaped disc screen 112. Mixed recyclable materials fall through the discs located along the intermediate portions of the vertically inclined regions 112*a* and 112*b*. Newspaper is conveyed upwardly over the output ends at the upper terminal ends of the vertically inclined regions 112*a* and 112*b*. Large articles such as plastic milk bottles and soda pop containers tumble down the vertically inclined regions 112*a* and 112*b* of the V-shaped disc screen 112 and eventually fall off of the side of the recycling apparatus 110. Thus a stream of mixed recyclable materials is conveyed onto one side of the V-shaped disc screen 112 by the conveyor 130 at the end marked "INFEED" in FIG. 5 and large articles are conveyed out the other side of the V-shaped disc screen 112 at the side marked "CONTAINERS OUT" FIG. 5. The lateral spacing between the discs 30 of the lowermost region 131 is less than the lateral spacing between the discs 30 of the vertically inclined regions 112*a* and 112*b*.

Persons skilled in the art of designing recycling apparatuses will be well familiar with the various mechanical details necessary to construct the recycling apparatuses 10 and 110 as well as the individual discs 30 and the bearing assemblies that support the square shafts 22. Such additional details may be found in my co-pending U.S. patent application Ser. No. 09/246,999 filed Feb. 8, 1999, and entitled "Stepped Disc Screens of Unequal Inclination Angles for Conveying and Grading Recyclable Materials," now U.S. Pat. No. 6,250,478, granted Jun. 26, 2001, the entire disclosure of which is specifically incorporated herein by reference.

While I have described two different embodiments of a recycling apparatus in accordance with the present invention, variations and modifications thereof will occur to those skilled in the art. For example, the means for generating the air streams could be provided in the form of individual fans or blowers that convey air directly onto the disc screens without utilization of any conduits. Therefore, the protection afforded my invention should only be limited in accordance with the following claims.

What is claimed is:

1. A recycling apparatus, comprising:

a frame;

a plurality of laterally extending shafts rotatably mounted in the frame at a plurality of progressively greater heights spaced along a longitudinal direction;

drive means for rotating the shafts;

a plurality of discs mounted on the shafts, the discs being dimensioned, configured and spaced for classifying a stream of mixed recyclable materials deposited onto the discs as the discs are rotated by the drive means to convey a portion of the stream along an inclined conveying direction; and an air manifold extending laterally across the plurality of discs for blowing air to help convey the portion of the stream upwardly off of the discs by rotation of the discs, wherein the air manifold includes at least one laterally extending conduit having a plurality of laterally spaced nozzles.

2. The recycling apparatus of claim 1 wherein the air manifold is mounted above the discs for blowing air downward toward the discs for pushing the portion of the stream against the discs.

3. The recycling apparatus of claim 1 wherein the axes of the shafts extend in a common plane.

4. The recycling apparatus of claim 1 wherein the shafts are arranged in a generally V-shaped configuration.

5. The recycling apparatus of claim 4 wherein the disc screen is also laterally inclined so that bottles and containers will travel laterally off of a lowermost region of the apparatus.

6. A recycling apparatus, comprising:

a frame;

a plurality of laterally extending shafts rotatably mounted in the frame at a plurality of progressively greater heights spaced along a longitudinal direction;

drive means for rotating the shafts;

a plurality of discs mounted on the shafts, the discs being dimensioned, configured and spaced for classifying a stream of mixed recyclable materials deposited onto the discs as the discs are rotated by the drive means to convey a portion of the stream along an inclined conveying direction; and an air manifold extending laterally across the plurality of discs for blowing air to help convey the portion of the stream upwardly off of the discs by rotation of the discs, wherein the air manifold includes a plurality of laterally extending and longitudinally spaced conduits each having a plurality of laterally spaced nozzles.

7. The recycling apparatus of claim 6 wherein the conduits are coupled to a longitudinally extending header.

8. The recycling apparatus of claim 7 and further comprising a blower coupled to the header.

9. A recycling apparatus, comprising:

a frame;

a plurality of laterally extending shafts rotatably mounted in the frame at a plurality of progressively greater heights spaced along a longitudinal direction;

drive means for rotating the shafts;

a plurality of discs mounted on the shafts, the discs being dimensioned, configured and spaced for classifying a stream of mixed recyclable materials deposited onto the discs as the discs are rotated by the drive means to convey a portion of the stream along an inclined conveying direction, each disc having a rigid inner frame and an elastomeric outer covering; and an air manifold extending laterally across the plurality of discs for blowing air to help convey the portion of the stream upwardly off of the discs by rotation of the discs.

10. A recycling apparatus for classifying a stream of mixed recyclable materials, comprising:

a frame;

a plurality of shafts rotatably mounted on the frame and spaced apart in a longitudinal direction at a plurality of different vertical heights to form a generally V- shaped configuration defining a centrally located lowermost region for receiving a stream of mixed recyclable materials and first and second vertically inclined regions extending from opposite sides of the lowermost region;

a plurality of discs mounted on each of the shafts, the discs being laterally spaced along corresponding shafts and interleaved with the discs of adjacent shafts;

means for rotating the shafts of a first portion of the lowermost region and the shafts of the first vertically inclined region adjacent thereto in a first direction to convey a first portion of the mixed stream of recyclable materials upwardly along the first vertically inclined region;

means for rotating the shafts of a second portion of the lowermost region and the shafts of the second vertically inclined region adjacent thereto in a second direction to convey a second portion of the mixed stream of recyclable materials upwardly along the second vertically inclined region;

an angle of vertical inclination and shape of the first and second vertically inclined regions being preselected and the discs of the lowermost region and the first and second vertically inclined regions being configured, dimensioned and spaced so that a broken glass component of the stream of mixed recyclable materials will fall through the discs of the lowermost region and newspaper will be carried over an upper end of each of the inclined regions; and the lowermost region being laterally inclined so that containers will move laterally off of the lowermost region.

11. The recycling apparatus of claim 10 and further comprising a first air manifold for directing air downwardly to press newspaper against the discs of the first vertically inclined region and a second air manifold for directing air downwardly to press newspaper against the discs of the second vertically inclined region.

12. The recycling apparatus of claim 11 wherein the first and second air manifolds each include a laterally extending conduit having a plurality of laterally spaced nozzles.

13. The recycling apparatus of claim 11 wherein the first and second air manifolds each include a plurality of laterally extending conduits each having a plurality of laterally spaced nozzles.

14. The recycling apparatus of claim 11 and further comprising a blower coupled to the first and second air manifolds.

15. The recycling apparatus of claim 11 wherein the first and second air manifolds are positioned sufficiently close to the first and second vertically inclined regions so that containers that are partially conveyed upwardly along the first and second vertically inclined regions can tumble over the first and second air manifolds.

16. The recycling apparatus of claim 10 wherein the discs each have an irregular outer contour for agitating the mixed recyclable materials.

17. The recycling apparatus of claim 10 wherein the discs each have an inner rigid frame and an elastomeric outer covering.

18. The recycling apparatus of claim 10 wherein each disc is separable into a plurality of sections that may be releasably clamped around a corresponding shaft.

19. The recycling apparatus of claim 10 wherein a lateral spacing between the discs of the lowermost region is less than lateral spacing between the discs of the first and second vertically inclined regions.

20. A recycling apparatus for classifying a stream of mixed recyclable materials, comprising:

a frame;

a plurality of shafts rotatably mounted on the frame and spaced apart in a longitudinal direction at a plurality of different vertical heights to form a generally V- shaped configuration defining a centrally located lowermost region for receiving a stream of mixed recyclable materials and first and second vertically inclined regions extending from opposite sides of the lowermost region;

a plurality of discs mounted on each of the shafts, the discs being laterally spaced along corresponding shafts and interleaved with the discs of adjacent shafts;

means for rotating the shafts of a first portion of the lowermost region and the shafts of the first vertically inclined region adjacent thereto in a first direction to convey a first portion of the mixed stream of recyclable materials upwardly along the first vertically inclined region;

means for rotating the shafts of a second portion of the lowermost region and the shafts of the second vertically inclined region adjacent thereto in a second direction to convey a second portion of the mixed stream of recyclable materials upwardly along the second vertically inclined region;

an angle of vertical inclination and shape of the first and second vertically inclined regions being preselected and the discs of the lowermost region and the first and second vertically inclined regions being configured, dimensioned and spaced so that a broken glass component of the stream of mixed recyclable materials will fall through the discs of the lowermost region, mixed paper will fall through the discs of the inclined regions, and newspaper will be carried over an upper end of each of the inclined regions;

the shafts of the lowermost region being laterally inclined so that containers will move laterally off of the lowermost region;

a first air manifold for directing air downwardly to press newspaper against the discs of the first vertically inclined region; and a second air manifold for directing air downwardly to press newspaper against the discs of the second vertically inclined region.

21. A recycling apparatus for classifying a stream of mixed recyclable materials, comprising:

a frame;

a plurality of shafts rotatably mounted on the frame and spaced apart in a longitudinal direction at a plurality of different vertical heights to form a generally V- shaped configuration defining a centrally located lowermost region for receiving a stream of mixed recyclable materials and first and second vertically inclined regions extending from opposite sides of the lowermost region;

a plurality of discs mounted on each of the shafts, the discs being laterally spaced along corresponding shafts and interleaved with the discs of adjacent shafts, wherein the discs each have an inner rigid frame and an elastomeric outer covering;

means for rotating the shafts of a first portion of the lowermost region and the shafts of the first vertically inclined region adjacent thereto in a first direction to convey a first portion of the mixed stream of recyclable materials upwardly along the first vertically inclined region;

means for rotating the shafts of a second portion of the lowermost region and the shafts of the second vertically inclined region adjacent thereto in a second direction to convey a second portion of the mixed stream of recyclable materials upwardly along the second vertically inclined region;

an angle of vertical inclination and shape of the first and second vertically inclined regions being preselected and the discs of the lowermost region and the first and second vertically inclined regions being configured, dimensioned and spaced so that a broken glass component of the stream of mixed recyclable materials will fall through the discs of the lowermost region, mixed paper will fall through the discs of the inclined regions, and newspaper will be carried over an upper end of each of the inclined regions; and the shafts of the lowermost region being laterally inclined so that containers will move laterally off of the lowermost region.

* * * * *